US008446344B2

(12) United States Patent
Choi

(10) Patent No.: US 8,446,344 B2
(45) Date of Patent: May 21, 2013

(54) PIXEL AND ORGANIC LIGHT EMITTING DISPLAY DEVICE USING THE SAME

(75) Inventor: Sang-Moo Choi, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1121 days.

(21) Appl. No.: 12/393,603

(22) Filed: Feb. 26, 2009

(65) Prior Publication Data

US 2009/0219232 A1 Sep. 3, 2009

(30) Foreign Application Priority Data

Feb. 28, 2008 (KR) ..... 10-2008-0018316

(51) Int. Cl.
*G09G 3/30* (2006.01)

(52) U.S. Cl.
USPC ..... 345/76; 345/82

(58) Field of Classification Search
USPC ..... 345/76–84, 204, 215, 690–699; 315/169, 315/1–169.4
See application file for complete search history.

(56) References Cited

U.S. PATENT DOCUMENTS

| | | | | |
|---|---|---|---|---|
| 2005/0140600 | A1* | 6/2005 | Kim et al. | 345/76 |
| 2005/0269958 | A1* | 12/2005 | Choi et al. | 315/169.3 |
| 2008/0111804 | A1* | 5/2008 | Choi et al. | 345/205 |

FOREIGN PATENT DOCUMENTS

| | | | |
|---|---|---|---|
| JP | 2004-302211 | A | 10/2004 |
| JP | 2006-38963 | A | 2/2006 |
| KR | 10-20060064194 | | 6/2006 |
| KR | 10-2006-0083101 | A | 7/2006 |
| KR | 10-20060134405 | | 12/2006 |
| KR | 10-2007-0057574 | | 6/2007 |
| KR | 10-20070057042 | | 6/2007 |

OTHER PUBLICATIONS

Korean Office action dated Apr. 3, 2009, for priority Korean application 10-2008-0018316.
Korean Office action dated Nov. 26, 2009, for priority Korean application 10-2008-0018316, noting listed references.

* cited by examiner

*Primary Examiner* — Kevin M Nguyen
*Assistant Examiner* — Sepideh Ghafari
(74) *Attorney, Agent, or Firm* — Christie, Parker & Hale, LLP

(57) ABSTRACT

A pixel of an organic light emitting display device and an organic light emitting display device using the same. The pixel is configured to compensate for the deterioration of organic light emitting diodes. The pixel includes an organic light emitting diode; a pixel circuit including a drive transistor for controlling an amount of electric current that flows from a first power source to a second power source via an organic light emitting diode; and a compensation unit between a gate electrode and a first electrode of the drive transistor for controlling a voltage of the gate electrode of the drive transistor to correspond to the deterioration of the organic light emitting diode. The compensation unit includes a transistor and a capacitor coupled in series between the gate electrode and the first electrode of the drive transistor.

16 Claims, 7 Drawing Sheets

PIXEL AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2008-0018316, filed on Feb. 28, 2008, in the Korean Intellectual Property Office, the entire content of which is incorporated herein by reference.

BACKGROUND OF THE INVENTION

1. Field of the Invention

The present invention relates to a pixel and an organic light emitting display device using the same.

2. Description of Related Art

In recent years, there have been many attempts to develop various flat panel displays having reduced weight and volume in comparison to the cathode ray tube display. The flat panel display devices include a liquid crystal display (LCD), a field emission display (FED), a plasma display panel (PDP), an organic light emitting display, etc.

Amongst the flat panel display devices, the organic light emitting display displays an image by using organic light emitting diodes which generate lights using the recombination of electrons and holes. The organic light emitting display device has advantages of a rapid response time and a low power consumption.

However, the conventional organic light emitting display device has a difficulty in displaying an image with a desired luminance due to deteriorating efficiency of the organic light emitting diodes (OLEDs) over time.

SUMMARY OF THE INVENTION

Accordingly, an aspect of the present invention is to provide a pixel capable of compensating for the deterioration of organic light emitting diodes and an organic light emitting display device using the same.

According to a first embodiment of the present invention, a pixel of an organic light emitting display is provided. The pixel includes: an organic light emitting diode; a pixel circuit including a drive transistor for controlling an amount of electric current that flows from a first power source to a second power source via the organic light emitting diode; and a compensation unit between a gate electrode of the drive transistor and a first electrode of the drive transistor for controlling a voltage at the gate electrode of the drive transistor to correspond to the deterioration of the organic light emitting diode. The compensation unit includes a compensation transistor and a first capacitor coupled in series between the gate electrode of the drive transistor and the first electrode of the drive transistor. The compensation transistor may be configured to turn off during a period in which a data signal is supplied to the pixel circuit. The first capacitor may determine a voltage level of a control voltage of the drive transistor according to a voltage applied to an anode electrode of the organic light emitting diode.

The pixel circuit may include: a second capacitor coupled between the gate electrode of the drive transistor and the first power source; an emission control transistor coupled between the first electrode of the drive transistor and the first power source, the emission control transistor configured to turn off when a light emitting control signal is applied to a light emitting control line that is coupled to a gate electrode of the emission control transistor; and a resetting transistor coupled between a reset power source and the gate electrode of the drive transistor, the resetting transistor configured to turn on when a first control signal is applied to a first control line that is coupled to a gate electrode of the resetting transistor.

The pixel may further include a switching transistor coupled between a data line and the gate electrode of the drive transistor. The switching transistor may be configured to turn on when a scan signal is applied to a scan line that is coupled to a gate electrode of the switching transistor.

The pixel circuit may further include: a switching transistor coupled between a data line and the first electrode of the drive transistor, the switching transistor configured to turn on when a scan signal is applied to a scan line that is coupled to a gate electrode of the switching transistor; a threshold compensating transistor coupled between the gate electrode and a second electrode of the drive transistor, the threshold compensating transistor configured to turn on when the scan signal is applied to the scan line that is coupled to a gate electrode of the threshold compensating transistor; a first emission control transistor coupled between the second electrode of the drive transistor and the organic light emitting diode, the first emission control transistor configured to turn off when the light emitting control signal is applied to the light emitting control line that is coupled to a gate electrode of the first emission control transistor; and a second emission control transistor coupled between the second electrode of the drive transistor and the organic light emitting diode, the second emission control transistor configured to turn off when a light emitting control signal is applied to a next light emitting control line.

The pixel circuit may further include: a switching transistor coupled between a data line and the first electrode of the drive transistor, the switching transistor configured to turn on when a scan signal is applied to a scan line that is coupled to a gate electrode of the switching transistor; a threshold compensating transistor coupled between the gate electrode and a second electrode of the drive transistor, the threshold compensating transistor configured to turn on when the scan signal is applied to the scan line that is coupled to a gate electrode of the threshold compensating transistor; and a first emission control transistor coupled between the second electrode of the drive transistor and the organic light emitting diode, the first emission control transistor configured to turn off when an inverse scan signal is applied to an inverse scan line that is coupled to a gate electrode of the first emission control transistor.

Another embodiment of the present invention provides an organic light emitting display device including a scan driver for sequentially supplying a scan signal to scan lines; a data driver for supplying a data signal to data lines; and pixels as set forth above at crossing regions between the scan lines and the data lines.

The pixel according to the embodiments of the present invention and the organic light emitting display device using the same provide a display that can display an image with a desired luminance as the organic light emitting diodes deteriorate over time by utilizing a compensation unit to compensate for the deterioration of the organic light emitting diodes.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
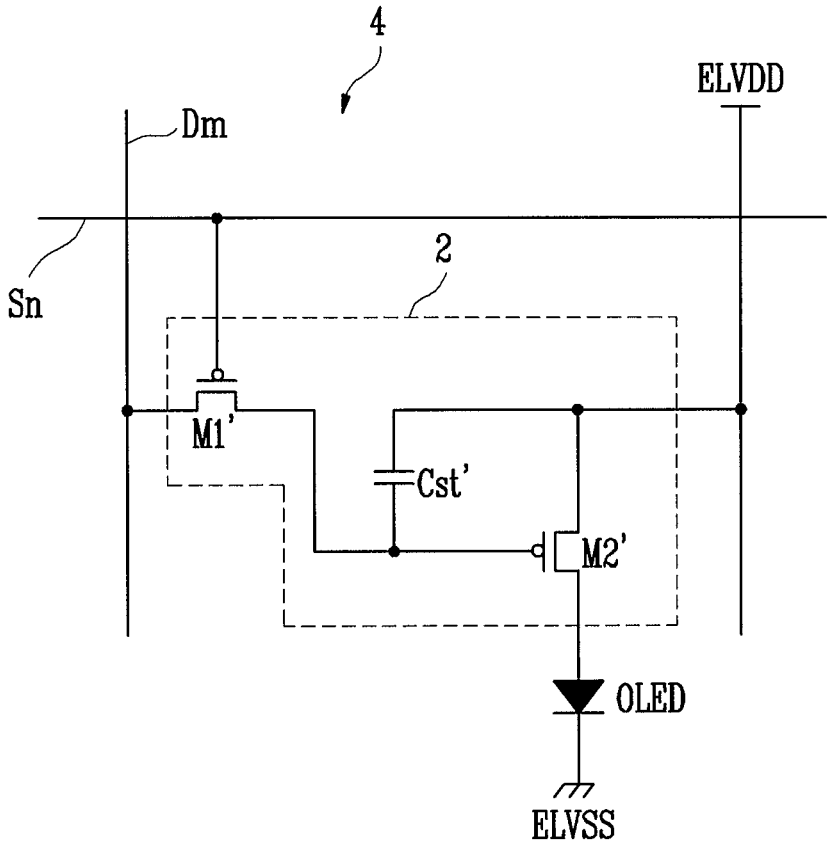
FIG. 1 is a circuit diagram showing a pixel of a conventional organic light emitting display device.

Hereinafter, certain exemplary embodiments according to the present invention will be described with reference to the accompanying drawings. Here, when a first element is described as being coupled to a second element, the first element may be directly coupled to the second element or indirectly coupled to the second element via a third element. Further, some of the elements that are not essential to the complete understanding of the invention are omitted for clarity. Also, like reference numerals refer to like elements throughout.

FIG. 1 is a circuit diagram showing a pixel 4 of a conventional organic light emitting display device.

Referring to FIG. 1, the pixel 4 of the conventional organic light emitting display device includes an organic light emitting diode (OLED) and a pixel circuit 2 coupled to a data line (Dm) and a scan line (Sn) to control the OLED.

An anode electrode of the OLED is coupled to the pixel circuit 2, and a cathode electrode is coupled to a second power source (ELVSS). The OLED generates light with a luminance (e.g., a predetermined luminance) corresponding to an electric current supplied from the pixel circuit 2.

The pixel circuit 2 receives a data signal from the data line (Dm) to control an amount of electric current supplied to the OLED when a scan signal is supplied to the pixel circuit 2 from the scan line (Sn). Here, the pixel circuit 2 includes a second transistor (M2') coupled between a first power source (ELVDD) and the OLED; a first transistor (M1') coupled between the second transistor (M2'), the data line (Dm) and the scan line (Sn); and a storage capacitor (Cst') coupled between a gate electrode and a first electrode of the second transistor (M2').

A gate electrode of the first transistor (M1') is coupled to the scan line (Sn), and its first electrode is coupled to the data line (Dm). A second electrode of the first transistor (M1') is coupled to a terminal of the storage capacitor (Cst'). Here, the first electrode is one of a source electrode or a drain electrode, and the second electrode is the other electrode of the source electrode or the drain electrode. For example, when the first electrode is a source electrode, the second electrode is a drain electrode. The first transistor (M1') coupled to the scan line (Sn) and the data line (Dm) is turned on when a scan signal is supplied to the transistor (M1') from the scan line (Sn), thus supplying a data signal from the data line (Dm) to the storage capacitor (Cst'). Therefore, the storage capacitor (Cst') is charged with a voltage corresponding to the data signal.

The gate electrode of the second transistor (M2') is coupled to a terminal of the storage capacitor (Cst'), and the first electrode is coupled to the other terminal of the storage capacitor (Cst') and the first power source (ELVDD). The second electrode of the second transistor (M2') is coupled to the anode electrode of the OLED. The second transistor (M2') controls an amount of electric current that flows from the first power source (ELVDD) to the second power source (ELVSS) via the OLED to correspond to a voltage value stored in the stored capacitor (Cst'). Here, the OLED generates light corresponding to the amount of electric current supplied from the second transistor (M2').

However, a conventional organic light emitting display device has a difficulty in displaying an image with a desired luminance due to the deteriorating efficiency of the OLEDs. That is to say, the OLEDs deteriorate over time, and therefore it is difficult to display an image with the desired luminance. As the OLEDs deteriorate over time, they generate light with lower luminance.

Figure 2:
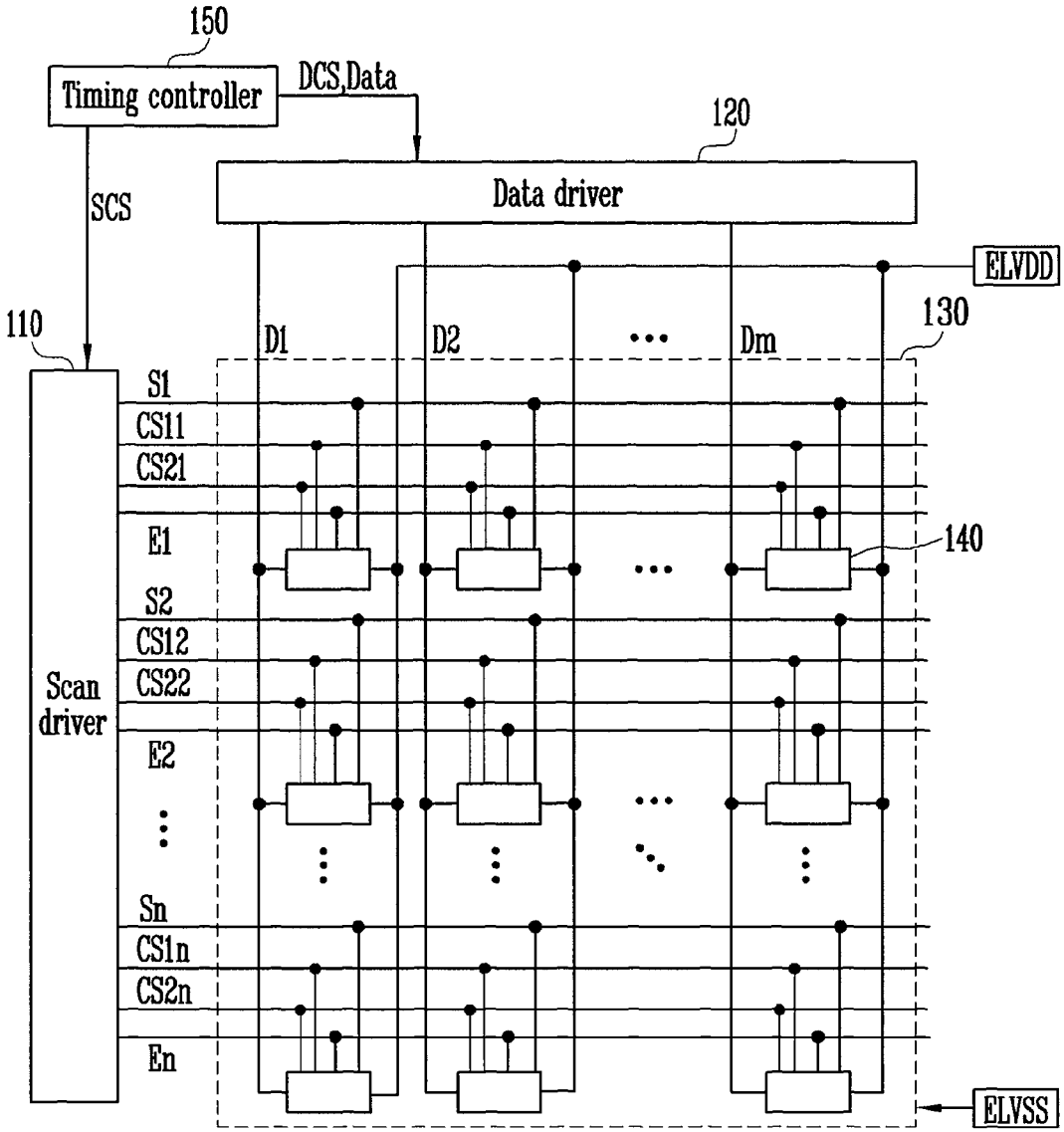
FIG. 2 is a block diagram showing an organic light emitting display device according to an exemplary embodiment of the present invention.

FIG. 2 is a block diagram showing an organic light emitting display device according to an exemplary embodiment of the present invention.

Referring to FIG. 2, the organic light emitting display device according to an exemplary embodiment of the present invention includes a display unit 130 including a plurality of pixels 140 coupled to scan lines (S1 to Sn), light emitting control lines (E1 to En), first control lines (CS11 to CS1*n*), second control lines (CS21 to CS2*n*) and data lines (D1 to Dm); a scan driver 110 for driving the scan lines (S1 to Sn), the light emitting control lines (E1 to En), the first control lines (CS11 to CS1*n*) and the second control lines (CS21 to CS2*n*); a data driver 120 for driving the data lines (D1 to Dm); and a timing controller 150 for controlling the scan driver 110 and the data driver 120.

The display unit 130 includes the pixels 140 disposed at crossing regions between the scan lines (S1 to Sn), the light emitting control lines (E1 to En), the first control lines (CS11 to CS1*n*), the second control lines (CS21 to CS2*n*) and the data lines (D1 to Dm). Each of the pixels 140 receives a first power source (ELVDD) and a second power source (ELVSS) from the outside. Each of the pixels 140 controls an amount of electric current to correspond to a data signal, and the electric current supplied by the first power source (ELVDD) flows to the second power source (ELVSS) via the OLED that generates light with a desired luminance (e.g., a predetermined luminance).

The timing controller 150 generates a data drive control signal (DCS) and a scan drive control signal (SCS) to correspond to externally supplied synchronization signals. The data drive control signal (DCS) generated in the timing controller 150 is supplied to the data driver 120, and the scan drive control signal (SCS) is supplied to the scan driver 110. The timing controller 150 receives externally supplied data (Data) and supplies the data (Data) to the data driver 120.

The scan driver 110 receives the scan drive control signal (SCS). The scan driver 110 receiving the scan drive control signal (SCS) supplies a drive waveform to the scan lines (S1 to Sn), the light emitting control lines (E1 to En), the first control lines (CS11 to CS1*n*) and the second control lines (CS21 to CS2*n*). For example, the scan driver 110 sequentially supplies a scan signal to the scan lines (S1 to Sn) and sequentially supplies a light emitting control signal to the light emitting control lines (E1 to En). The scan driver 110 sequentially supplies a first control signal to the first control lines (CS11 to CS1*n*) and sequentially supplies a second control signal to the second control lines (CS21 to CS2*n*).

Here, the scan signal and the first control signal are set to a voltage value of LOW level, and the light emitting control signal and the second control signal are set to a voltage value of HIGH level. The light emitting control signal supplied to an $i^{th}$ (i is an integer) light emitting control line (Ei) overlaps with the scan signal supplied to an $(i-1)^{th}$ scan line (Si−1) and an $i^{th}$ scan line (Si). Also, the second control signal supplied to an $i^{th}$ second control line (CS2*i*) overlaps with the scan signal supplied to an $i^{th}$ scan line (Si) and an $(i+1)^{th}$ scan line (Si+1). In addition, the first control signal supplied to an $i^{th}$ first control line (CS1*i*) overlaps with the scan signal supplied to an $(i-1)^{th}$ scan line (Si−1).

The data driver 120 receives the data drive control signal (DCS) from the timing controller 150 and generates a data signal that is supplied to the data lines (D1 to Dm).

Figure 3:
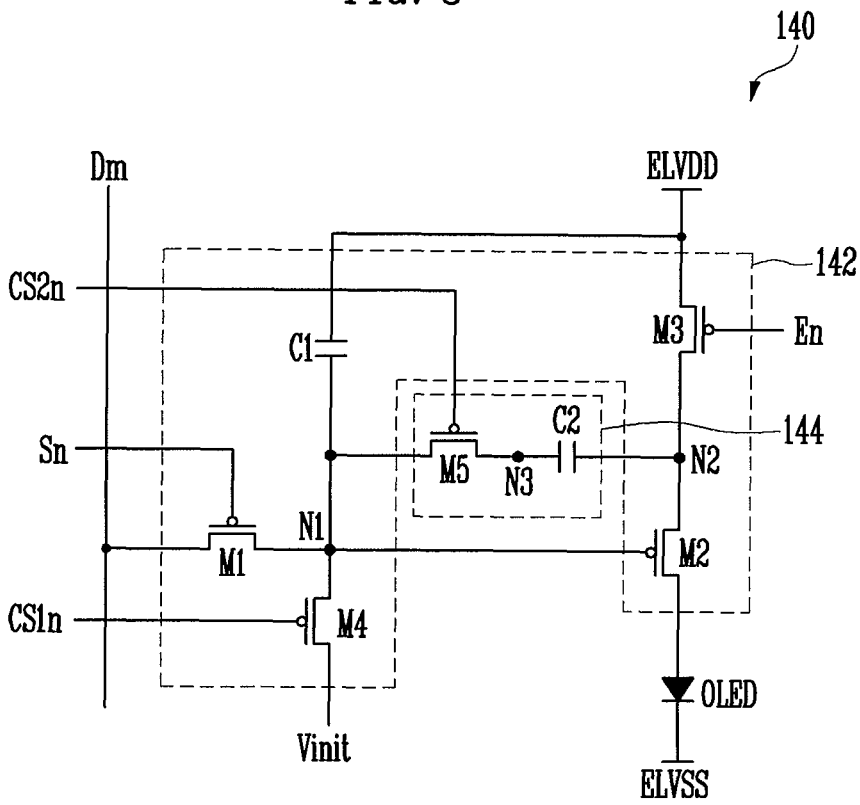
FIG. 3 is a circuit diagram showing a pixel according to a first exemplary embodiment as shown in FIG. 2.

FIG. 3 is a circuit diagram showing a pixel according to a first exemplary embodiment as shown in FIG. 2. FIG. 3 shows a pixel 140 coupled to an $n^{th}$ scan line (Sn) and an $m^{th}$ data line (Dm) for the convenience of description.

Referring to FIG. 3, the pixel 140 according to the first exemplary embodiment of the present invention includes an OLED; a pixel circuit 142 for controlling an amount of electric current supplied to the OLED; and a compensation unit 144 for compensating for the deterioration of the OLED.

An anode electrode of the OLED is coupled to the pixel circuit 142, and a cathode electrode is coupled to a second power source (ELVSS). The OLED generates light with a luminance (e.g., a predetermined luminance) to correspond to an amount of electric current supplied from the drive transistor (i.e., a second transistor (M2)) in the pixel circuit 142.

The pixel circuit 142 controls the amount of electric current supplied to the OLED. Here, the pixel circuit 142 includes first to fourth transistors (M1 to M4) and a first capacitor (C1).

A gate electrode of the first transistor (M1) (e.g., a switching transistor) is coupled to an $n^{th}$ scan line (Sn), and its first electrode is coupled to the data line (Dm). A second electrode of the first transistor (M1) is coupled to a gate electrode (i.e., a first node (N1)) of the second transistor (M2). The first transistor (M1) is turned on when a scan signal is supplied to the scan line (Sn), thus supplying a data signal to the first node (N1). The data signal is supplied from the data line (Dm).

The gate electrode of the second transistor (M2) is coupled to the first node (N1), and its first electrode is coupled to a second electrode (i.e., a second node (N2)) of the third transistor (M3) (e.g., an emission control transistor). The second electrode of the second transistor (M2) is coupled to the anode electrode of the OLED. The second transistor (M2) controls the amount of electric current to correspond to a voltage applied to the first node (N1). The electric current flows from the first power source (ELVDD) to the second power source (ELVSS) via the OLED. Here, the first power source (ELVDD) is set to a higher voltage value than the second power source (ELVSS).

A gate electrode of the third transistor (M3) is coupled to the $n^{th}$ light emitting control line (En), and its first electrode is coupled to the first power source (ELVDD). The second electrode of the third transistor (M3) is coupled to the second node (N2). The third transistor (M3) is turned off when a light emitting control signal, which is supplied from the $n^{th}$ light emitting control line (En), is applied to its gate electrode; and turned on when the light emitting control signal is deasserted.

A gate electrode of the fourth transistor (M4) (e.g., a resetting transistor) is coupled to a first control line (CS1*n*), and its first electrode is coupled to the first node (N1). A second electrode of the fourth transistor (M4) is coupled to a reset power source (Vinit). The fourth transistor (M4) is turned on when a first control signal, which is supplied from the first control line (CS1*n*), is applied to its gate electrode, thus electrically coupling the first node (N1) to the reset power source (Vint). Here, a voltage of the reset power source (Vint) may be set to a voltage level to turn on the second transistor (M2).

The first capacitor (C1) is formed between the first node (N1) and the first power source (ELVDD). The first capacitor (C1) is charged with a voltage corresponding to the data signal.

The compensation unit 144 is disposed between the gate electrode and the first electrode of the second transistor (M2), and controls a voltage of the first node (N1) to compensate for the deterioration of the OLEDs. The compensation unit 144 includes a fifth transistor (M5) (e.g., a compensation transistor) and a second capacitor (C2), which are disposed in series between the first node (N1) and the second node (N2).

A first electrode of the fifth transistor (M5) is coupled to the first node (N1), and its second electrode is coupled to a terminal (i.e., a third node (N3)) of the second capacitor (C2). A gate electrode of the fifth transistor (M5) is coupled to a second control line (CS2*n*). The fifth transistor (M5) is turned off when a second control signal, which is supplied from the second control line (CS2*n*), is applied to its gate electrode; and turned on when the second control signal is deasserted. Here, because the second control signal overlaps with the scan signal, the fifth transistor (M5) is turned off during a period in which a voltage corresponding to the data signal is charged in the first capacitor (C1).

The second capacitor (C2) is formed between the third node (N3) and the second node (N2). The second capacitor (C2) is charged with a voltage (e.g., a predetermined voltage) to compensate for the deterioration of the OLED. Here, the second capacitor (C2) has a lower capacity than the first capacitor (C1). The second capacitor (C2) is charged with a voltage that corresponds to a voltage applied to the anode electrode of the OLED.

The pixel 140 according to the present invention is not limited to the above-described configuration. In fact, the pixel circuit 142 may have other circuit configurations.

Figure 4:
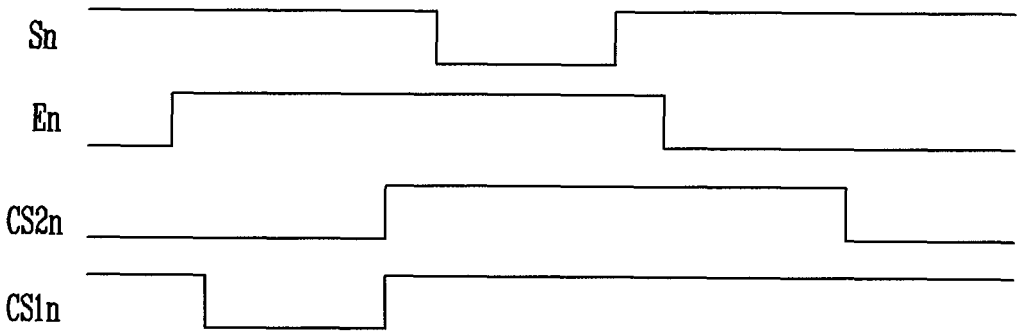
FIG. 4 is a waveform diagram showing a method for driving a pixel as shown in FIG. 2.

FIG. 4 is a waveform diagram showing a method for driving a pixel as shown in FIG. 3.

The method for driving a pixel will be described in more detail with reference to FIGS. 3 and 4. First, a first control signal is supplied to a first control line (CS1*n*), and a light emitting control signal is supplied to a light emitting control line (En). When the light emitting control signal (e.g., a low level signal) is supplied to the light emitting control line (En), the third transistor (M3) is turned off.

When the first control signal (e.g., a low level signal) is supplied to the first control line (CS1*n*), the fourth transistor (M4) is turned on. When the fourth transistor (M4) is turned on, voltages of the first node (N1) and the third node (N3) are set to a voltage value of the reset power source (Vint). Here, when the second transistor (M2) is turned on, a voltage applied to the anode electrode of the organic light emitting diode (OLED) is supplied to the second node (N2).

Then, a scan signal (e.g., a low level signal) is supplied to the scan line (Sn), and a second control signal (e.g., a high level signal) is supplied to the second control line (CS2*n*). The supply of the first control signal to the first control line (CS1*n*) is deasserted (e.g., a high level signal).

When the supply of the first control signal to the first control line (CS1*n*) is deasserted, the fourth transistor (M4) is turned off. When the second control signal (e.g., a high level signal) is supplied to the second control line (CS2*n*), the fifth transistor (M5) is turned off. When a scan signal (e.g., a low level signal) is supplied to the scan line (Sn), the first transistor (M1) is turned on. When the first transistor (M1) is turned on, a data signal is supplied to the first node (N1). Therefore, the first capacitor (C1) is charged with a voltage corresponding to the data signal.

After the voltage corresponding to the data signal is charged in the first capacitor (C1), the scan signal applied to the scan line (Sn) and the light emitting control applied to the light emitting control line (En) are deasserted. When the scan signal applied to the scan line (Sn) is deasserted, the first transistor (M1) is turned off. When the light emitting control signal applied to the light emitting control line (En) is deasserted, a voltage of the first power source (ELVDD) is supplied to the second node (N2). Here, a voltage of the second node (N2) increases from the voltage, which is applied to the anode electrode of the OLED, to the voltage of the first power source (ELVDD). A voltage of the third node (N3) is changed according to the magnitude of the increasing voltage of the second node (N2).

Then, the supply of the second control signal to the second control line (CS2*n*) is deasserted. When the supply of the second control signal is deasserted, the fifth transistor (M5) is turned on. When the fifth transistor (M5) is turned on, charges stored at the first capacitor (C1) and the second capacitor (C2) are shared between the capacitors ("charge sharing"). Here, a voltage of the first node (N1) is determined by the following Equation 1.

$$V_{N1}=\{C1\times V\text{data}+C2\times(\text{ELVDD}+V\text{int}-V\text{oled})\}/(C1+C2) \quad \text{Equation 1}$$

In the Equation 1, Vdata represents a voltage value of a data signal, and Voled represents a voltage of the anode electrode of the OLED. According to the Equation 1, a voltage of the first node (N1) decreases as a voltage (Voled) of the anode electrode of the OLED increases in the pixel 140 according to the first exemplary embodiment of the present invention.

Here, the voltage (Voled) of the anode electrode of the OLED increases as the OLED deteriorates. Therefore, it is possible to compensate for the deterioration of the OLED since a voltage of the gate electrode of the second transistor (M2) decreases to correspond to the deterioration of the OLED. That is to say, a voltage of the first node (N1) decreases as the OLED deteriorates over time, and therefore more electric current is supplied to the OLED to correspond to the same data signal.

As the OLED deteriorates over time, an amount of electric current supplied to the OLED is increased to compensate for the decrease in luminance due to the deterioration of the OLED.

Figure 5:
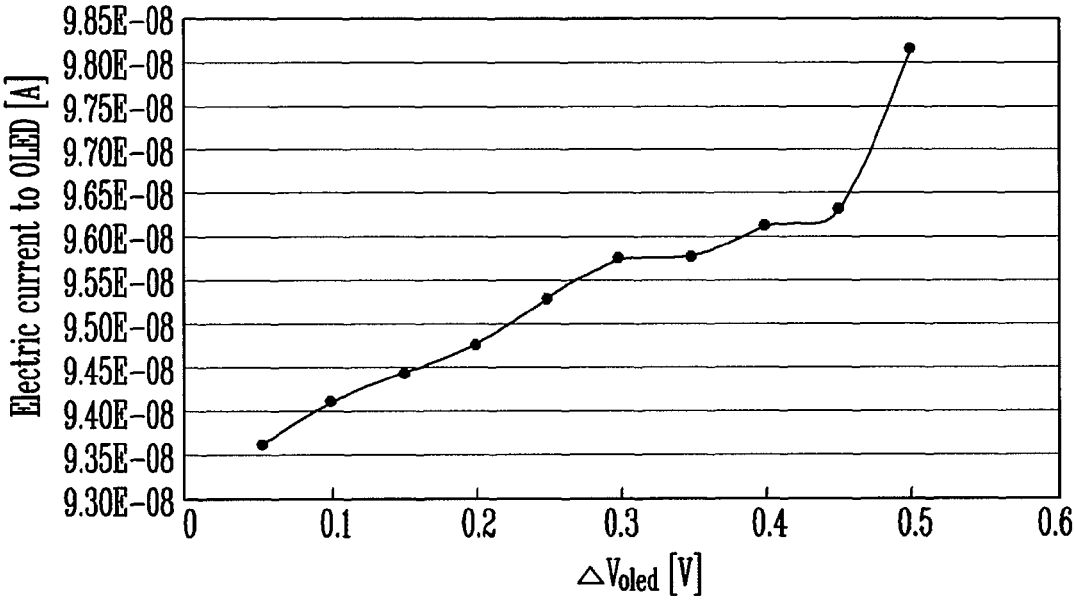
FIG. 5 is a graph showing a simulation result of the pixel as shown in FIG. 3.

FIG. 5 is a graph showing a simulation result of a pixel as shown in FIG. 3.

Referring to FIG. 5, a first capacitor (C1) is set to 0.6 pF, and a second capacitor (C2) is set to 0.08 pF. ΔVoled represents the change in a voltage (Voled) of an anode electrode of the OLED according to the deterioration of the OLED.

Referring to FIG. 5, when the same data signal is applied, an amount of electric current supplied to the OLED increases as the voltage (Voled) of the anode electrode of the OLED increases. Therefore, it is possible to display an image with a desired luminance regardless of the state of the deterioration of the OLEDs according to the described embodiments of the present invention.

Figure 6:
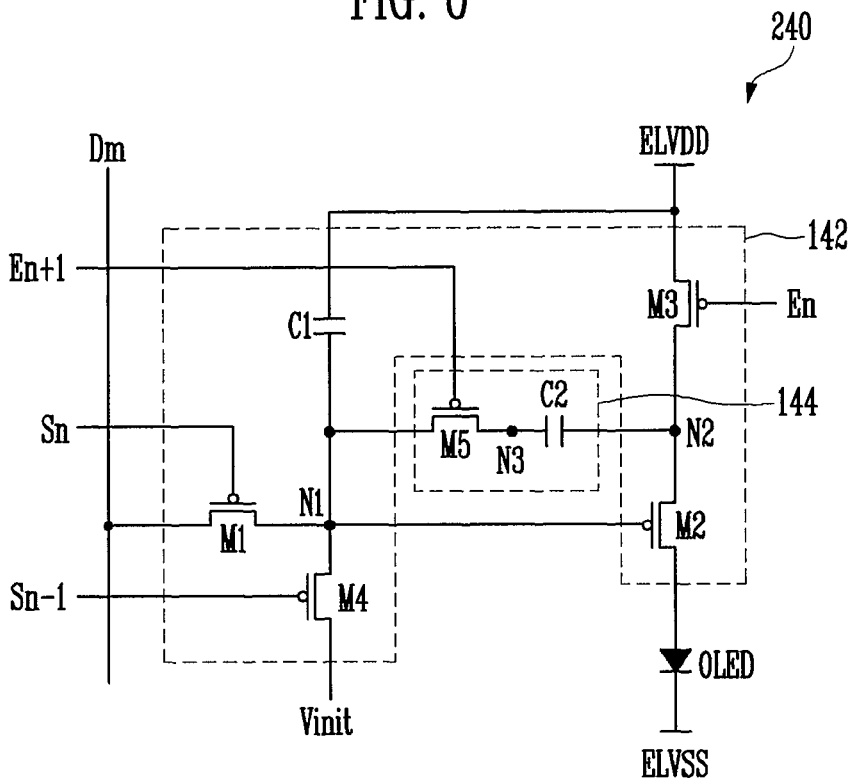
FIG. 6 is a circuit diagram showing a pixel according to a second exemplary embodiment as shown in FIG. 2.

FIG. 6 is a circuit diagram showing a pixel according to a second exemplary embodiment of the present invention. The same components as in FIG. 3 have the same reference numerals, and their detailed descriptions are omitted for clarity in FIG. 6.

Referring to FIG. 6, a fourth transistor (M4) of the pixel 240 according to the second exemplary embodiment of the present invention is coupled to an $(n-1)^{th}$ scan line (Sn−1), and a fifth transistor (M5) is coupled to an $(n+1)^{th}$ light emitting control line (En+1).

Figure 7:
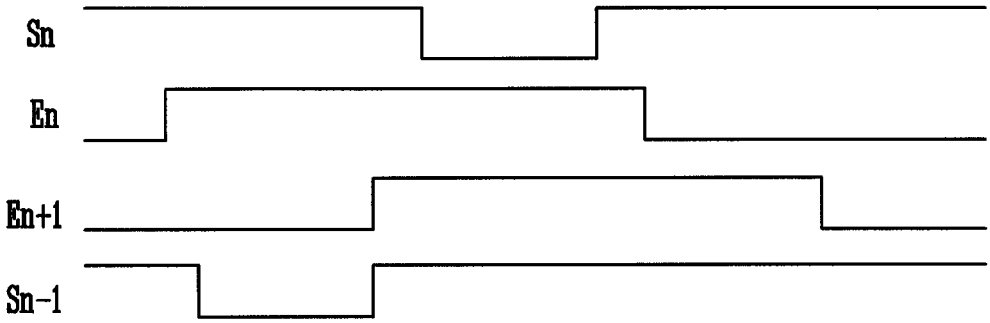
FIG. 7 is a waveform diagram showing a method for driving a pixel as shown in FIG. 6.

In FIG. 3, the fourth transistor (M4) is coupled to a first control line (CS1*n*). Here, a first control signal supplied to the first control line (CS1*n*) has the same timing as a scan signal supplied to the $(n-1)^{th}$ scan line (Sn−1) as shown in FIG. 7. Therefore, the fourth transistor (M4) may be stably driven when it is coupled to the $(n-1)^{th}$ scan line (Sn−1).

Also, in FIG. 3, the fifth transistor (M5) is coupled to a second control line (CS2*n*). Here, a second control signal supplied to the second control line (CS2*n*) has the same timing as a light emitting control signal supplied to the $(n+1)^{th}$ light emitting control line (En+1) as shown in FIG. 7. Therefore, the fifth transistor (M5) may be stably driven when it is coupled to the $(n+1)^{th}$ light emitting control line (En+1).

As described above, the pixel 240 according to the second exemplary embodiment of the present invention is not coupled to the control lines (CS1*n* and CS2*n*), but coupled to the $(n-1)^{th}$ scan line (Sn−1) and the $(n+1)^{th}$ light emitting control line (En+1). Therefore, the pixel 240 according to the second exemplary embodiment of the present invention can be driven without using the control lines (CS11 to CS1*n*, CS21 to CS2*n*), compared to the pixel 140 as shown in FIG. 3.

Figure 8:
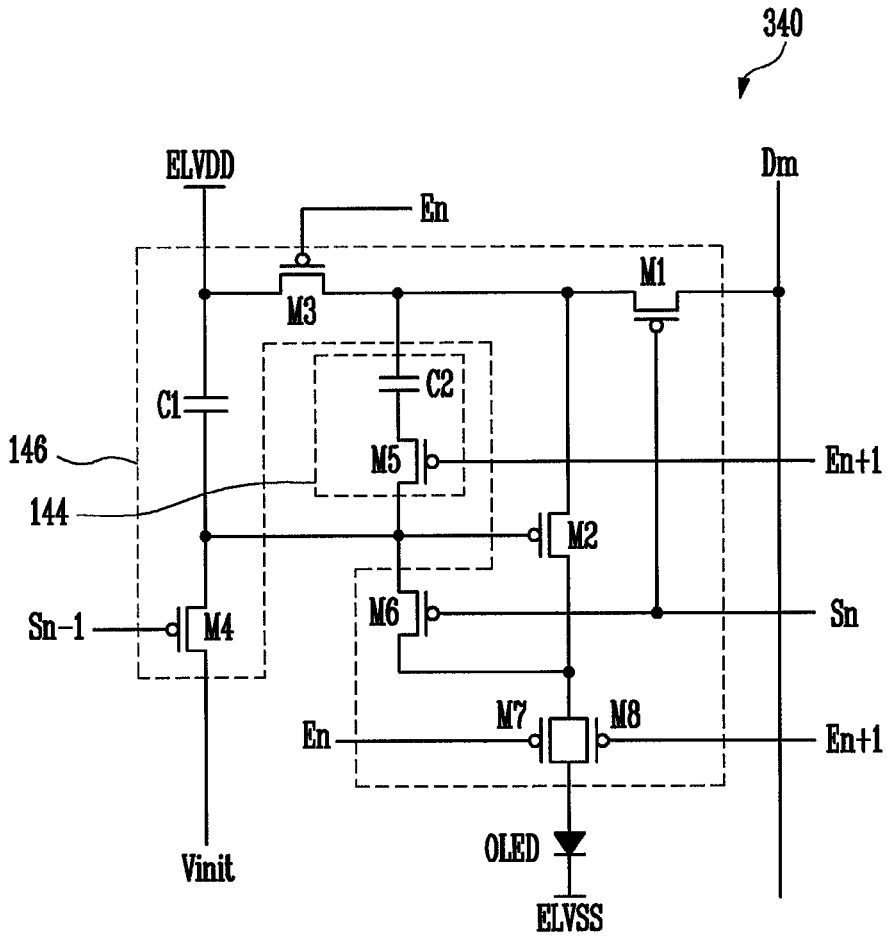
FIG. 8 is a circuit diagram showing a pixel according to a third exemplary embodiment as shown in FIG. 2.

FIG. 8 is a circuit diagram showing a pixel according to a third exemplary embodiment of the present invention.

Referring to FIG. 8, the pixel 340 according to the third exemplary embodiment of the present invention includes an OLED; a pixel circuit 146 for controlling an amount of electric current supplied to the OLED; and a compensation unit 144 for compensating the deterioration of the OLED.

An anode electrode of the OLED is coupled to the pixel circuit 146, and a cathode electrode is coupled to the second power source (ELVSS). The OLED generates light with a luminance (e.g., a predetermined luminance) to correspond to the amount of electric current supplied from the drive transistor (i.e., a second transistor (M2)) in the pixel circuit 146.

The pixel circuit 146 controls an amount of electric current supplied to the OLED. Comparing the pixel circuit 146 with the pixel circuit 142 as shown in FIG. 3, the pixel circuit 146 according to the third exemplary embodiment of the present invention includes an additional transistor to compensate for a threshold voltage of the drive transistor. In FIG. 8, the pixel circuit 146 according to the third exemplary embodiment of the present invention includes first to fourth transistors (M1 to M4), sixth to eighth transistors (M6 to M8) and a first capacitor (C1).

A gate electrode of the first transistor (M1) is coupled to an $n^{th}$ scan line (Sn), and its first electrode is coupled to the data line (Dm). A second electrode of the first transistor (M1) is coupled to a first electrode of the second transistor (M2). The first transistor (M1) is turned on when a scan signal, which is supplied to the scan line (Sn), is applied to its gate electrode, thus supplying a data signal from the data line (Dm) to the first electrode of the second transistor (M2).

A gate electrode of the second transistor (M2) is coupled to a terminal of the first capacitor (C1), and its first electrode is coupled to the second electrode of the first transistor (M1). The second electrode of the second transistor (M2) is coupled to first electrodes of the seventh transistor (M7) and the eighth transistor (M8). The second transistor (M2) controls an amount of electric current to correspond to the voltage stored in the first capacitor (C1), and the electric current flows from the first power source (ELVDD) to the second power source (ELVSS) via the OLED.

A gate electrode of the third transistor (M3) is coupled to an $n^{th}$ light emitting control line (En), and its first electrode is coupled to the first power source (ELVDD). A second electrode of the third transistor (M3) is coupled to the first electrode of the second transistor (M2). The third transistor (M3) is turned off when a light emitting control signal, which is supplied to the $n^{th}$ light emitting control line (En), is applied to its gate electrode, and turned on when the light emitting control signal is deasserted.

A gate electrode of the fourth transistor (M4) is coupled to an $(n-1)^{th}$ scan line (Sn−1), and its first electrode is coupled to the gate electrode of the second transistor (M2). A second electrode of the fourth transistor (M4) is coupled to a reset power source (Vint). Such a fourth transistor (M4) is turned on when a scan signal, which is supplied from the $(n-1)^{th}$ scan line (Sn−1), is applied to its gate electrode, thus electrically coupling the gate electrode of the second transistor (M2) to the reset power source (Vint).

A first electrode of the sixth transistor (M6) (e.g., a threshold compensating transistor) is coupled to the second electrode of the second transistor (M2), and its second electrode is coupled to the gate electrode of the second transistor (M2). A gate electrode of the sixth transistor (M6) is coupled to the $n^{th}$ scan line (Sn). The sixth transistor (M6) is turned on when a scan signal, which is supplied to the $n^{th}$ scan line (Sn), is applied to its gate electrode, thus configuring the second transistor (M2) in a diode-connected configuration.

The seventh transistor (M7) (e.g., a first emission control transistor) and the eighth transistor (M8) (e.g., a second emission control transistor) are coupled in parallel between the first electrode of the second transistor (M2) and the anode electrode of the OLED. The seventh transistor (M7) is turned off when a light emitting control signal, which is supplied to an $n^{th}$ light emitting control line (En), is applied to its gate electrode and turned on when the light emitting control signal is deasserted. The eighth transistor (M8) is turned off when a light emitting control signal, which is supplied from an $(n+1)^{th}$ light emitting control line (En+1), is applied to its gate electrode and turned on when the light emitting control signal is deasserted.

The first capacitor (C1) is formed between the gate electrode of the second transistor (M2) and the first power source (ELVDD). The first capacitor (C1) is charged with a voltage corresponding to a data signal and a threshold voltage of the second transistor (M2).

The compensation unit 144 is disposed between the gate electrode and the first electrode of the second transistor (M2), and controls a voltage of the gate electrode in the second transistor (M2) to compensate for the deterioration of the OLED. Here, the compensation unit 144 includes a fifth transistor (M5) and a second capacitor (C2), which are disposed in series between the gate electrode and the first electrode of the second transistor (M2).

A first electrode of the fifth transistor (M5) is coupled to the gate electrode of the second transistor (M2), and its second electrode is coupled to a first terminal of the second capacitor (C2). A gate electrode of the fifth transistor (M5) is coupled to the $(n+1)^{th}$ light emitting control line (En+1). The fifth transistor (M5) is turned off when a light emitting control signal, which is supplied to the $(n+1)^{th}$ light emitting control line (En+1), is applied to its gate electrode and turned on when the light emitting control signal is deasserted.

For the second capacitor (C2), the first terminal is coupled to the second electrode of the fifth transistor (M5), and a second terminal is coupled to the first electrode of the second transistor (M2). The second capacitor (C2) is charged with a voltage (e.g., a predetermined voltage) to compensate for the deterioration of the OLED.

Here, the $(n+1)^{th}$ light emitting control line (En+1) and the $(n-1)^{th}$ scan line (Sn−1) may be substituted with a second control line (CS2*n*) and a first control line (CS1*n*), respectively.

The method for driving a pixel will be described in more detail with reference to FIGS. 7 and 8. First, a scan signal is supplied to an $(n-1)^{th}$ scan line (Sn−1), and a light emitting control signal is supplied to an $n^{th}$ light emitting control line (En). When the light emitting control signal (e.g., a high level signal) is supplied to the $n^{th}$ light emitting control line (En), the third transistor (M3) and seventh transistor (M7) are turned off.

When the scan signal (e.g., a low level signal) is supplied to the $(n-1)^{th}$ scan line (Sn−1), the fourth transistor (M4) is turned on. When the fourth transistor (M4) is turned on, a voltage of a reset power source (Vint) is supplied to a gate electrode of the second transistor (M2) and a second terminal of the second capacitor (C2). When the second transistor (M2) is turned on, a voltage applied to an anode electrode of the OLED is supplied to a second terminal of the second capacitor (C2).

Then, a scan signal is supplied to the $n^{th}$ scan line (Sn), and a light emitting control signal is supplied to the $(n+1)^{th}$ light emitting control line (En+1). The scan signal to the $(n-1)^{th}$ scan line (Sn−1) is deasserted.

When the scan signal to the $(n-1)^{th}$ scan line (Sn−1) is deasserted, the fourth transistor (M4) is turned off. When the light emitting control signal (e.g., a high level signal) is supplied to the $(n+1)^{th}$ light emitting control line (En+1), the fifth transistor (M5) and the eighth transistor (M8) are turned off. When the scan signal (e.g., a low level signal) is supplied to the $n^{th}$ scan line (Sn), the first transistor (M1) and the sixth transistor (M6) are turned on.

When the first transistor (M1) is turned on, the data signal supplied from the data line (Dm) is supplied to the first electrode of the second transistor (M2). When the sixth transistor (M6) is turned on, the second transistor (M2) is diode-connected. When, the second transistor (M2) is turned on the gate electrode of the second transistor (M2) is reset to a voltage of the reset power source (Vint). As a result, the data signal supplied from the data line (Dm) is supplied to one terminal of the first capacitor (C1) via the second transistor (M2) and the sixth transistor (M6). At this time, the first capacitor (C1) is charged with a voltage corresponding to the data signal and the threshold voltage of the second transistor (M2).

Here, when the first transistor (M1) is turned on, a voltage of the second terminal of the second capacitor (C2) increases from a voltage applied to the anode electrode of the OLED to a voltage applied to the first power source (ELVDD). At this time, a voltage of the first terminal of the second capacitor (C2) is changed according to the magnitude of the increased voltage of the second terminal. In FIG. 8, the voltage of the first terminal of the second capacitor (C2) is changed into a voltage of ELVDD+Vint−Voled. Here, the voltage of the gate electrode of the second transistor (M2) maintains a voltage of Vdata−|Vth| (a threshold voltage of the second transistor (M2)).

After a voltage (e.g., a predetermined voltage) is charged in the first capacitor (C1), the scan signal supplied to the $n^{th}$ scan line (Sn) and the light emitting control signal supplied to the $n^{th}$ light emitting control line (En) are deasserted. When the light emitting control signal supplied to the $n^{th}$ light emitting control line (En) is deasserted, the seventh transistor (M7) is turned on. When the scan signal to the $n^{th}$ scan line (Sn) is deasserted, the first transistor (M1) and the sixth transistor (M6) are turned off.

Then, the light emitting control signal supplied to the $(n+1)^{th}$ light emitting control line (En+1) is deasserted. When the light emitting control signal supplied to the $(n+1)^{th}$ light emitting control line (En+1) is deasserted, the fifth transistor (M5) and the eighth transistor (M8) are turned on.

When the fifth transistor (M5) is turned on, charges between the first capacitor (C1) and the second capacitor (C2) are shared between the two capacitors ("charge sharing"). Here, a voltage of the gate electrode of the second transistor (M2) is determined by the following Equation 2.

$$Vgate=\{C1\times(Vdata-|Vth|)+C2\times(ELVDD+Vinit-Voled)\}/(C1+C2) \quad \text{Equation 2}$$

In the Equation 2, Vgate represents a voltage of a gate electrode of the second transistor (M2). According to the Equation 2, the voltage of the gate electrode of the second transistor (M2) decreases as a voltage (Voled) of the anode electrode of the OLED increases. Therefore, as the OLED becomes increasingly deteriorated, an amount of electric current supplied to the OLED increases to compensate for the decrease in luminance due to the deterioration of the OLED.

Figure 9:
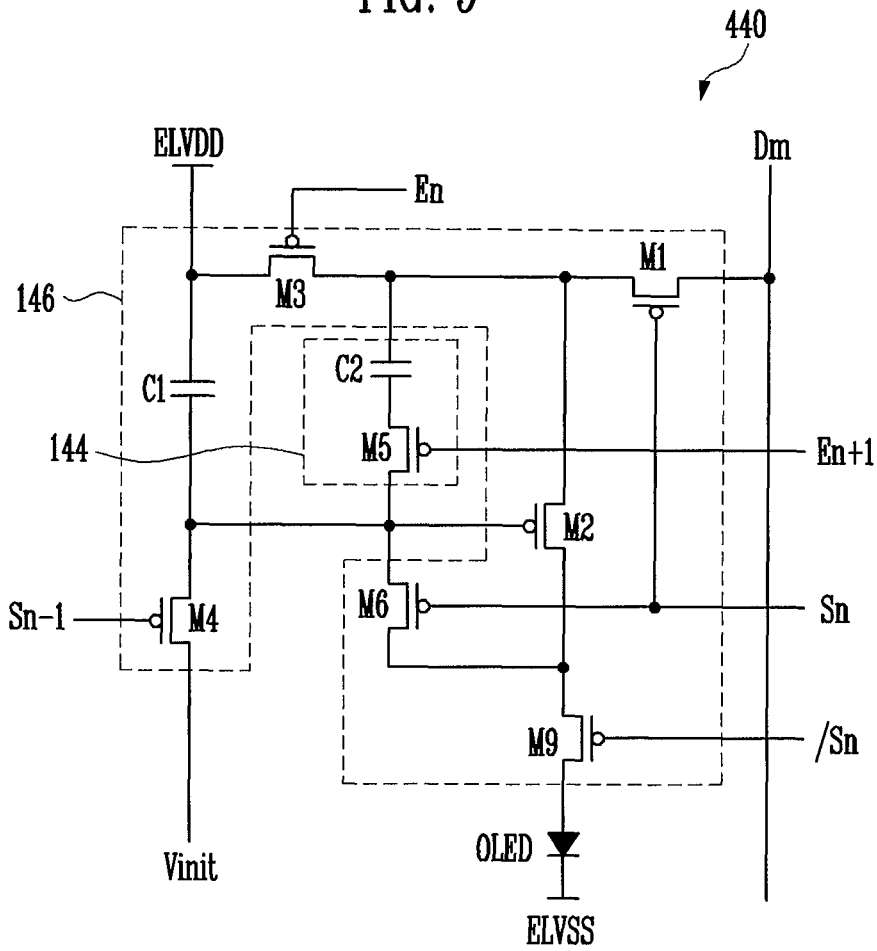
FIG. 9 is a circuit diagram showing a pixel according to a fourth exemplary embodiment as shown in FIG. 2.

FIG. 9 is a circuit diagram showing a pixel according to a fourth exemplary embodiment of the present invention. The detailed descriptions of the same components as shown in FIG. 8 are omitted for clarity in FIG. 9.

Figure 10:
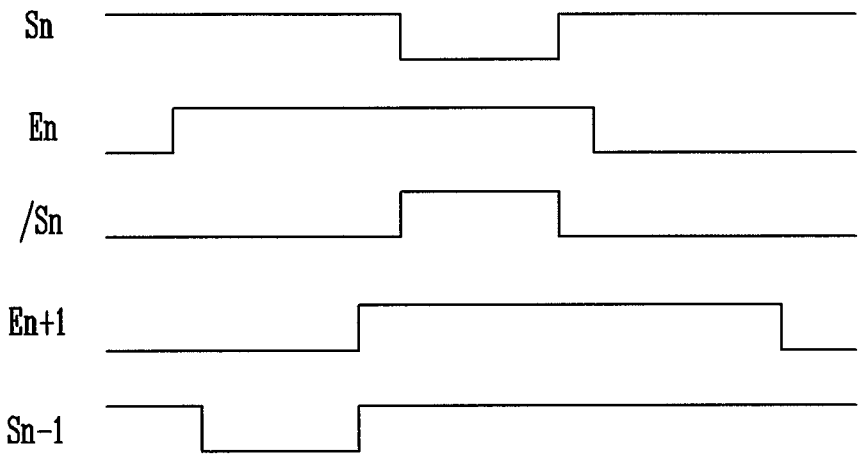
FIG. 10 is a waveform diagram showing a method for driving a pixel as shown in FIG. 9.

Referring to FIG. 9, the pixel 440 according to the fourth exemplary embodiment of the present invention includes a ninth transistor (M9) (e.g., a first emission control transistor) disposed between the second electrode of the second transistor (M2) and the anode electrode of the OLED. The ninth transistor (M9) is turned off when an inverse scan signal (e.g., a high level signal) is supplied to an inverse scan line (/Sn), and turned on when the inverse scan signal is deasserted, as shown in FIG. 10. Here, the inverse scan signal supplied to the inverse scan line (/Sn) has an inversed polarity relative to the scan signal supplied to the scan line, and overlaps with the scan signal. The inverse scan signal has a width identical to or wider than the scan signal.

FIG. 10 is a waveform diagram showing a method for driving a pixel as shown in FIG. 9.

The method for driving a pixel will be described in more detail with reference to FIGS. 9 and 10. First, a scan signal is supplied to an $(n-1)^{th}$ scan line (Sn−1), and a light emitting control signal is supplied to an $n^{th}$ light emitting control line (En). When the light emitting control signal (e.g., a low level signal) is supplied to the $n^{th}$ light emitting control line (En), the third transistor (M3) is turned off.

When the scan signal (e.g., a low level signal) is supplied to the $(n-1)^{th}$ scan line (Sn−1), the fourth transistor (M4) is turned on. When the fourth transistor (M4) is turned on, a voltage of a reset power source (Vinit) is supplied to a gate electrode of the second transistor (M2) and a first terminal of the second capacitor (C2). At this time, the second transistor (M2) is turned on to supply a voltage, which is applied to the anode electrode of the OLED, to a second terminal of the second capacitor (C2).

Then, a scan signal is supplied to an $n^{th}$ scan line (Sn), and an inverse scan signal is supplied to an $n^{th}$ inverse scan line (/Sn). A light emitting control signal is supplied to an $(n+1)^{th}$ light emitting control line (En+1), and the scan signal supplied to the $(n-1)^{th}$ scan line (Sn−1) is deasserted.

When the scan signal supplied to the $(n-1)^{th}$ scan line (Sn−1) is deasserted, the fourth transistor (M4) is turned off. When the inverse scan signal is supplied to the $n^{th}$ inverse scan line (/Sn), the ninth transistor (M9) is turned off. When the light emitting control signal is supplied to the $(n+1)^{th}$ light emitting control line (En+1), the fifth transistor (M5) is turned off. When the scan signal is supplied to the $n^{th}$ scan line (Sn), the first transistor (M1) and the sixth transistor (M6) are turned on.

When the first transistor (M1) is turned on, the data signal supplied from the data line (Dm) is supplied to the first electrode of the second transistor (M2). When the sixth transistor (M6) is turned on, the second transistor (M2) is diode-connected. Here, since the gate electrode of the second transistor (M2) is reset to a voltage of the reset power source (Vint), the second transistor (M2) is turned on. Then, the data signal supplied to the data line (Dm) is supplied to one terminal of the first capacitor (C1) via the second transistor (M2) and the sixth transistor (M6). Here, the first capacitor (C1) is charged with a voltage corresponding to the data signal and a threshold voltage of the second transistor (M2).

When the first transistor (M1) is turned on, a voltage of the second terminal of the second capacitor (C2) increases from a voltage, which is applied to the anode electrode of the OLED, to a voltage of the first power source (ELVDD). A voltage of the first terminal of the second capacitor (C2) changes according to the magnitude of the increasing voltage of the second terminal.

After a voltage (e.g., a predetermined voltage) is charged in the first capacitor (C1), the scan signal supplied to the $n^{th}$ scan line (Sn), the inverse scan signal supplied to the $n^{th}$ inverse scan line (/Sn) and the light emitting control signal supplied to the $n^{th}$ light emitting control line (En) are deasserted. When the inverse scan signal supplied to the $n^{th}$ inverse scan line (/Sn) is deasserted, the ninth transistor (M9) is turned on. When the light emitting control signal supplied to the $n^{th}$ light emitting control line (En) is deasserted, the third transistor (M3) is turned on. When the scan signal supplied to the $n^{th}$ scan line (Sn) is deasserted, the first transistor (M1) and the sixth transistor (M6) are turned off.

Then, the light emitting control signal supplied to the $(n+1)^{th}$ light emitting control line (En+1) is deasserted. When the light emitting control signal supplied to the $(n+1)^{th}$ light emitting control line (En+1) is deasserted, the fifth transistor (M5) is turned on.

When the fifth transistor (M5) is turned on, charges stored in the first capacitor (C1) and the second capacitor (C2) are shared between the capacitors ("charge sharing"). Here, a voltage of the gate electrode of the second transistor (M2) is determined by the Equation 2. That is to say, the pixel 440 according to the fourth exemplary embodiment of the present invention may compensate for the decrease in luminance due to the deterioration of the OLED by increasing an amount of electric current supplied to the OLED as the OLED becomes increasingly deteriorated.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel of an organic light emitting display, the pixel comprising:

an organic light emitting diode;

a pixel circuit comprising a drive transistor for controlling an amount of electric current that flows from a first power source to a second power source via the organic light emitting diode; and a compensation unit between a gate electrode of the drive transistor and a first electrode of the drive transistor for controlling a voltage at the gate electrode of the drive transistor to correspond to the deterioration of the organic light emitting diode, wherein the compensation unit comprises a compensation transistor and a first capacitor coupled in series between the gate electrode of the drive transistor and the first electrode of the drive transistor, and wherein the compensation transistor is configured to turn off during a period in which a data signal is supplied to the pixel circuit.

2. The pixel according to claim 1, wherein the first capacitor determines a voltage level of a control voltage of the drive transistor according to a voltage applied to an anode electrode of the organic light emitting diode.

3. A pixel of an organic light emitting display, the pixel comprising:

an organic light emitting diode;

a pixel circuit comprising a drive transistor for controlling an amount of electric current that flows from a first power source to a second power source via the organic light emitting diode; and a compensation unit between a gate electrode of the drive transistor and a first electrode of the drive transistor for controlling a voltage at the gate electrode of the drive transistor to correspond to the deterioration of the organic light emitting diode, wherein the compensation unit comprises a compensation transistor and a first capacitor coupled in series between the gate electrode of the drive transistor and the first electrode of the drive transistor, and wherein the pixel circuit comprises:

a second capacitor coupled between the gate electrode of the drive transistor and the first power source;

an emission control transistor coupled between the first electrode of the drive transistor and the first power source, the emission control transistor configured to turn off when a light emitting control signal is applied to a light emitting control line that is coupled to a gate electrode of the emission control transistor; and a resetting transistor coupled between a reset power source and the gate electrode of the drive transistor, the resetting transistor configured to turn on when a first control signal is applied to a first control line that is coupled to a gate electrode of the resetting transistor.

4. The pixel according to claim 3, further comprising a switching transistor coupled between a data line and the gate electrode of the drive transistor, the switching transistor configured to turn on when a scan signal is applied to a scan line that is coupled to a gate electrode of the switching transistor.

5. The pixel according to claim 3, wherein a voltage of the reset power source has a voltage value that turns on the drive transistor.

6. The pixel according to claim 3, wherein the second capacitor has a higher capacitance than the first capacitor.

7. The pixel according to claim 3, wherein the compensation transistor is configured to turn off when a second control signal is applied to a second control line that is coupled to a gate electrode of the compensation transistor.

8. The pixel according to claim 7, wherein the light emitting control signal applied to the light emitting control line overlaps with a scan signal applied to a scan line and a scan signal applied to a previous scan line, and the second control signal applied to the second control line overlaps with the scan signal applied to the scan line and a next scan line.

9. The pixel according to claim 7, wherein the first control signal applied to the first control line overlaps with a scan signal applied to a previous scan line.

10. The pixel according to claim 8, wherein the second control line is the next light emitting control line.

11. The pixel according to claim 9, wherein the first control line is the previous scan line.

12. The pixel according to claim 3, wherein the pixel circuit further comprises:

a switching transistor coupled between a data line and the first electrode of the drive transistor, the switching transistor configured to turn on when a scan signal is applied to a scan line that is coupled to a gate electrode of the switching transistor;

a threshold compensating transistor coupled between the gate electrode and a second electrode of the drive transistor, the threshold compensating transistor configured to turn on when the scan signal is applied to the scan line that is coupled to a gate electrode of the threshold compensating transistor;

a first emission control transistor coupled between the second electrode of the drive transistor and the organic light emitting diode, the first emission control transistor configured to turn off when the light emitting control signal is applied to the light emitting control line that is coupled to a gate electrode of the first emission control transistor; and a second emission control transistor coupled between the second electrode of the drive transistor and the organic light emitting diode, the second emission control transistor configured to turn off when a light emitting control signal is applied to a next light emitting control line.

13. The pixel according to claim 3, wherein the pixel circuit further comprises:

a switching transistor coupled between a data line and the first electrode of the drive transistor, the switching transistor configured to turn on when a scan signal is applied to a scan line that is coupled to a gate electrode of the switching transistor;

a threshold compensating transistor coupled between the gate electrode and a second electrode of the drive transistor, the threshold compensating transistor configured to turn on when the scan signal is applied to the scan line that is coupled to a gate electrode of the threshold compensating transistor; and a first emission control transistor coupled between the second electrode of the drive transistor and the organic light emitting diode, the first emission control transistor configured to turn off when an inverse scan signal is applied to an inverse scan line that is coupled to a gate electrode of the first emission control transistor.

14. The pixel according to claim 13, wherein the inverse scan signal applied to the inverse scan line has an inversed polarity relative to the scan signal applied to the scan line and has a width identical or broader than the scan signal.

15. An organic light emitting display device comprising:

a scan driver for sequentially applying a scan signal to scan lines;

a data driver for applying a data signal to data lines; and pixels at crossing regions between the scan lines and the data lines, wherein each of the pixels comprises:

an organic light emitting diode;

a pixel circuit comprising a drive transistor for controlling an amount of electric current that flows from a first power source to a second power source via the organic light emitting diode; and a compensation unit between a gate electrode of the drive transistor and a first electrode of the drive transistor for controlling a voltage at the gate electrode of the drive transistor to correspond to the deterioration of the organic light emitting diode, wherein the compensation unit comprises a compensation transistor and a first capacitor coupled in series between the gate electrode of the drive transistor and the first electrode of the drive transistor, and wherein the compensation transistor is configured to turn off during a period in which the data signal is supplied to the pixel circuit.

16. The organic light emitting display device according to claim 15, wherein the first capacitor determines a voltage level of a control voltage of the drive transistor according to a voltage applied to an anode electrode of the organic light emitting diode.

* * * * *